US009984673B2

(12) United States Patent
Jung

(10) Patent No.: US 9,984,673 B2
(45) Date of Patent: May 29, 2018

(54) METHOD OF CANCELLING NOISE AND ELECTRONIC DEVICE THEREFOR

(71) Applicant: Samsung Electronics Co., Ltd., Suwon-si, Gyeonggi-do (KR)

(72) Inventor: Yong-Beom Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days. days.

(21) Appl. No.: 15/341,370

(22) Filed: Nov. 2, 2016

(65) Prior Publication Data

US 2017/0133002 A1 May 11, 2017

(30) Foreign Application Priority Data

Nov. 11, 2015 (KR) ..... 10-2015-0158369

(51) Int. Cl.
*G10K 11/16* (2006.01)
*G10K 11/178* (2006.01)

(52) U.S. Cl.
CPC ..... *G10K 11/1788* (2013.01); *G10K 11/1785* (2018.01); *G10K 11/17821* (2018.01); *G10K 11/17885* (2018.01); *G10K 2210/1081* (2013.01); *G10K 2210/129* (2013.01); *G10K 2210/3213* (2013.01)

(58) Field of Classification Search
CPC ..... G10K 11/178; G10K 2210/129; G10K 2210/1081; G10K 2210/3221; G10K 11/1784; G10K 11/1786; G10K 2210/108; G10K 2210/3022; G10K 2210/30351; G10K 2210/3056; G10K 2210/3213; G10K 2210/501; H04R 2420/07; H04R 2499/11; H04R 25/505; H04R 3/005; H04R 1/1008; H04R 2460/13; H04R 25/353; H04R 25/405; H04R 25/407; H04R 1/1016; H04R 1/1083; H04R 2225/021; H04R 2225/025; H04R 2410/05; H04R 25/305; H04R 3/02; H04R 5/033; H04M 19/04
USPC ..... 381/71.6, 123, 58, 71.11, 91, 94.1, 71.2
See application file for complete search history.

(56) References Cited

U.S. PATENT DOCUMENTS 8,977,376 B1 3/2015 Lin et al.
2013/0024194 A1* 1/2013 Zhao ..... G10L 21/0208 704/228
2013/0156208 A1* 6/2013 Banba ..... G10L 21/0208 381/60
2013/0208908 A1* 8/2013 Theiler ..... G10K 11/178 381/71.6

(Continued)

FOREIGN PATENT DOCUMENTS

KR 10-2014-0013606 A 2/2014

*Primary Examiner* — Norman Yu
(74) *Attorney, Agent, or Firm* — Jefferson IP Law, LLP

(57) ABSTRACT

A method of removing noise and an electronic device thereof are provided. The electronic device includes a speaker, a first sensor configured to output a first signal by obtaining noise around the electronic device, a second sensor configured to output a second signal by detecting vibrations around the electronic device, and a controller configured to determine whether the second signal satisfies a condition of not exceeding a certain threshold value, and output an acoustic signal to be output through the speaker based on the first signal according to a result of the determination.

12 Claims, 10 Drawing Sheets

(56) References Cited

U.S. PATENT DOCUMENTS

| | | | | |
|---|---|---|---|---|
| 2013/0287219 | A1* | 10/2013 | Hendrix | G10K 11/175 381/71.6 |
| 2014/0072135 | A1 | 3/2014 | Bajic et al. | |
| 2014/0086425 | A1 | 3/2014 | Jensen et al. | |
| 2014/0341388 | A1 | 11/2014 | Goldstein et al. | |
| 2015/0071453 | A1 | 3/2015 | Po et al. | |
| 2015/0228292 | A1* | 8/2015 | Goldstein | G10L 21/0208 381/71.6 |
| 2016/0267898 | A1* | 9/2016 | Terlizzi | H04R 1/1091 |

* cited by examiner

Ideal Case of ANC

When the headphone vibrate

METHOD OF CANCELLING NOISE AND ELECTRONIC DEVICE THEREFOR

CROSS-REFERENCE TO RELATED APPLICATION(S)

This application claims the benefit under 35 U.S.C. § 119(a) of a Korean patent application filed on Nov. 11, 2015 in the Korean Intellectual Property Office and assigned Serial number 10-2015-0158369, the entire disclosure of which is hereby incorporated by reference.

TECHNICAL FIELD

The present disclosure relates to a method of cancelling noise and an electronic device thereof. More particularly, the present disclosure relates to a method of stably cancelling noise and an electronic device thereof, which may prevent noise from being generated by a physical vibration or abnormal input that is not connected with acoustic noise in the air, in the electronic device to which the ANC technology is applied.

BACKGROUND

Active noise cancellation (ANC) technology is based on the wave superposition principle, which generates the waveform opposite to the waveform of noise and actively reduces acoustic noise in the air. Generally, the ANC technology detects a noise reference signal from the outside using one or more microphones, generates a signal having a waveform of which a phase is shifted by 180 degrees from the noise reference signal, and reproduces the same through one or more speakers. Accordingly, the waveform of the original noise reference signal and the waveform of which the phase is shifted by 180 degrees may experience destructive interference, and thus, noise arriving at the ears of a user may be reduced.

An active noise cancellation (ANC) circuit may be applied to recent portable electronic devices (for example, an electronic device that is used for listening sound in noisy environments, such as a portable phone, a smart phone, a music player, ear phones, a headphone, and the like), and thus, noise from the surroundings may be reduced. The ANC circuit may be mounted on, for example, a headphone, and may reduce external noise by reproducing noise collected by a microphone from the surroundings as a signal in a waveform of which a phase is shifted by 180 degrees. However, when vibrations are applied to the headphone itself or abnormally excessive input is generated, unintended noise may occur. This may cause the ANC circuit to detect a noise signal that actually does not exist in the audible frequency or a distorted noise signal due to a physical vibration or abnormal input in a microphone. When the ANC circuit reproduces the same as a signal in a phase shifted waveform, noise that does not actually exist in the audible frequency may be generated and displeasure and audio shock may be delivered to a user.

Therefore, a need exists for a method of stably cancelling noise and an electronic device thereof, which may prevent noise from being generated by a physical vibration or abnormal input that is not connected with acoustic noise in the air, in the electronic device to which the ANC technology is applied.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method of stably cancelling noise and an electronic device thereof, which may prevent noise from being generated by a physical vibration or abnormal input that is not connected with acoustic noise in the air, in the electronic device to which the ANC technology is applied.

In accordance with an aspect of the present disclosure, an electronic device is provided. The electronic device includes a speaker, at least one microphone, at least one sensor, and a control circuit that is electrically connected with the speaker, the at least one microphone, and the at least one sensor, wherein the control circuit executes generating a first signal by detecting vibrations occurring around the electronic device using the at least one sensor, determining whether the generated first signal satisfies a selected condition, generating a second signal by obtaining noise occurring around the electronic device using the at least one microphone when the first signal satisfies the selected condition, and generating an acoustic signal to be output through the speaker based on the generated second signal, and generating an acoustic signal to be output through the speaker irrespective of the second signal when the first signal does not satisfy the selected condition.

In accordance with another aspect of the present disclosure, an electronic device is provided. The electronic device includes a speaker, at least one microphone, at least one sensor, and a control circuit that is electrically connected with the speaker, the at least one microphone, and the at least one sensor, wherein the control circuit executes generating a first signal by detecting vibrations occurring around the electronic device using the at least one sensor, generating a second signal by obtaining noise occurring around the electronic device using the at least one microphone, and generating an acoustic signal to be output through the speaker based on the first signal and the second signal.

In accordance with another aspect of the present disclosure, an electronic device is provided. The electronic device includes a communication circuit, a speaker, at least one microphone, and a control circuit that is electrically connected with the communication circuit, the speaker, and the at least one microphone, wherein the control circuit executes receiving, using the communication circuit from an external device, a first signal generated from the external device by vibrations occurring around the external device, determining whether the received first signal satisfies a selected condition, generating, when the first signal satisfies the selected condition, a second signal by obtaining noise occurring around the electronic device, using the at least one microphone, and generating an acoustic signal to be output through the speaker based on the generated second signal, generating, when the first signal does not satisfy the selected condition, an acoustic signal to be output through the speaker, irrespective of the second signal.

In accordance with another aspect of the present disclosure, an electronic device is provided. The electronic device includes a speaker, at least one sensor, and a control circuit that is electrically connected with the speaker and the at least one sensor, wherein the control circuit executes generating a first signal by detecting vibrations occurring around the electronic device using the at least one sensor, and generating an acoustic signal to be output through the speaker based on the first signal.

In accordance with another aspect of the present disclosure, a method of cancelling noise using an electronic device is provided. The method includes generating a first signal by detecting vibrations occurring around the electronic device using at least one sensor, determining whether the generated first signal satisfies a selected condition, generating, when the generated first signal satisfies the selected condition, a second signal by obtaining noise occurring around the electronic device using at least one microphone, and generating an acoustic signal to be output through a speaker based on the generated second signal, and generating, when the first signal does not satisfy the selected condition, an acoustic signal to be output through the speaker irrespective of the second signal.

In accordance with another aspect of the present disclosure, a method of cancelling noise using an electronic device is provided. The method includes generating a first signal by detecting vibrations occurring around the electronic device using at least one sensor, generating a second signal by obtaining noise occurring around the electronic device using at least one microphone, and generating an acoustic signal to be output through a speaker based on the first signal and the second signal.

In accordance with another aspect of the present disclosure, a method of removing noise using an electronic device is provided. The method includes receiving, through a communication circuit from an external device, a first signal generated from the external device by vibrations occurring around the external device, determining whether the received first signal satisfies a selected condition, generating, when the first signal satisfies the selected condition, a second signal by obtaining noise occurring around the electronic device using at least one microphone, and generating an acoustic signal to be output through a speaker based on the generated second signal, and generating, when the first signal does not satisfy the selected condition, an acoustic signal to be output through the speaker irrespective of the second signal.

In accordance with another aspect of the present disclosure, a method of removing noise using an electronic device is provided. The method includes generating a first signal by detecting vibrations occurring around the electronic device using at least one sensor, and generating an acoustic signal to be output through the speaker based on the first signal.

According to various embodiments of the present disclosure, an electronic device to which the ANC technology is applied may prevent noise from being generated by a physical vibration or abnormal input that is not connected with acoustic noise in the air, and thus, may stably cancel noise.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
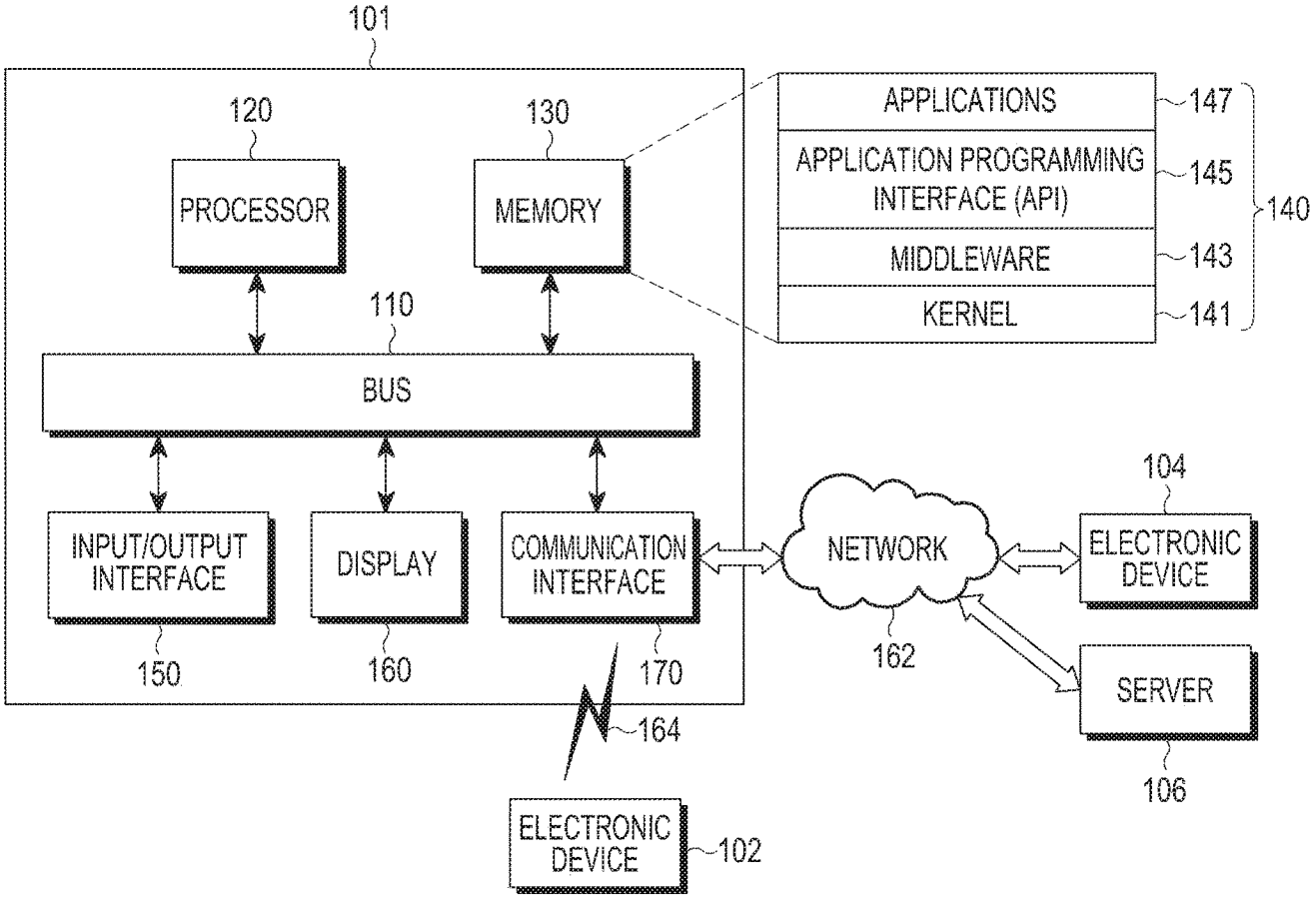
FIG. 1 is a block diagram of an electronic device in a network environment according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

As used herein, the expression "have", "may have", "include", or "may include" refers to the existence of a corresponding feature (e.g., a numeral, a function, an operation, or a constituent element, such as a component), and does not exclude one or more additional features.

In various embodiments of the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., a first element) is referred to as being (operatively or communicatively) "connected," or "coupled," to another element (e.g., a second element), it may be directly connected or coupled directly to the other element or any other element (e.g., a third element) may be interposer between them. In contrast, it may be understood that when an element (e.g., the first element) is referred to as being "directly connected," or "directly coupled" to another element (e.g., the second element), there are no element (e.g., the third element) interposed between them.

The expression "configured to" used in various embodiments of the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g., an embedded processor) only for performing the corresponding operations or a generic-purpose processor (e.g., a central processing unit (CPU) or an application processor (AP)) that can perform the corresponding operations by executing one or more software programs stored in a memory device.

Unless defined otherwise, all terms used herein, including technical and scientific terms, have the same meaning as those commonly understood by a person skilled in the art to which the present disclosure pertains. Such terms as those defined in a generally used dictionary may be interpreted to have the meanings equal to the contextual meanings in the relevant field of art, and are not to be interpreted to have ideal or excessively formal meanings unless clearly defined in various embodiments of the present disclosure. In some cases, even the term defined in various embodiments of the present disclosure should not be interpreted to exclude embodiments of the present disclosure.

An electronic device according to various embodiments of the present disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a moving picture experts group phase 1 or phase 2 (MPEG-1 or MPEG-2) audio layer-3 (MP3) player, a mobile medical device, a camera, and a wearable device. According to various embodiments of the present disclosure, the wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit).

According to various embodiments of the present disclosure, the electronic device may be a home appliance. The home appliance may include at least one of, for example, a television (TV), a digital versatile disc (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

According to an embodiment of the present disclosure, the electronic device may include at least one of various medical devices (e.g., various portable medical measuring devices (a blood glucose monitoring device, a heart rate monitoring device, a blood pressure measuring device, a body temperature measuring device, and the like), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment devices, an electronic devices for a ship (e.g., a navigation device for a ship, and a gyro-compass), avionics, security devices, an automotive head unit, a robot for home or industry, an automatic teller's machine (ATM) in banks, point of sales (POS) in a shop, or Internet device of things (e.g., a light bulb, various sensors, electric or gas meter, a sprinkler device, a fire alarm, a thermostat, a streetlamp, a toaster, a sporting goods, a hot water tank, a heater, a boiler, and the like).

According to various embodiments of the present disclosure, the electronic device may include at least one of a part of furniture or a building/structure, an electronic board, an electronic signature receiving device, a projector, and various kinds of measuring instruments (e.g., a water meter, an electric meter, a gas meter, and a radio wave meter). In various embodiments of the present disclosure, the electronic device may be a combination of one or more of the aforementioned various devices. The electronic device according to various embodiments of the present disclosure may be a flexible device. Further, the electronic device according to an embodiment of the present disclosure is not limited to the aforementioned devices, and may include a new electronic device according to the development of technology.

Hereinafter, an electronic device according to various embodiments will be described with reference to the accompanying drawings. As used herein, the term "user" may indicate a person who uses an electronic device or a device (e.g., an artificial intelligence electronic device) that uses an electronic device.

FIG. 1 is a block diagram of an electronic device in a network environment according to various embodiments of the present disclosure.

Referring to FIG. 1, an electronic device 101 may include a bus 110, a processor 120, a memory 130, an input/output interface 150, a display 160, and a communication module 170. According to an embodiment of the present disclosure, the electronic device 101 may omit at least one of the components or further include other components.

The bus 110 may include a circuit for connecting the components and transmitting communication between the components (e.g., control messages and/or data).

The processor 120 may include one or more of a CPU, an AP, and a communications processor (CP). For example, the processor 120 may carry out operations or data processing related to control and/or communication of at least one other component of the electronic device 101.

The memory 130 may include a volatile memory and/or a non-volatile memory. The memory 130 may store, for example, instructions or data relevant to at least one other component of the electronic device 101. According to an embodiment of the present disclosure, the memory 130 may store software and/or a program 140. The program 140 may include, for example, a kernel 141, middleware 143, an application programming interface (API) 145, and/or application programs (or "applications") 147. At least some of the kernel 141, the middleware 143, and the API 145 may be referred to as an operating system (OS).

The kernel 141 may control or manage system resources (e.g., the bus 110, the processor 120, or the memory 130) used for performing an operation or function implemented by the other programs (e.g., the middleware 143, the API 145, or the application programs 147). Furthermore, the kernel 141 may provide an interface through which the middleware 143, the API 145, or the application programs 147 may access the individual components of the electronic device 101 to control or manage the system resources.

The middleware 143, for example, may function as an intermediary for allowing the API 145 or the application programs 147 to communicate with the kernel 141 to exchange data.

In addition, the middleware 143 may process one or more task requests received from the application programs 147 according to priorities thereof. For example, the middleware 143 may assign, to at least one of the application programs 147, priorities for using the system resources (e.g., the bus 110, the processor 120, the memory 130, and the like) of the electronic device 101. For example, the middleware 143 may perform scheduling or loading balancing on the one or more task requests by processing the one or more task requests according to the priorities assigned thereto.

The API 145 is an interface through which the applications 147 control functions provided from the kernel 141 or the middleware 143, and may include, for example, at least one interface or function (e.g., an instruction) for file control, window control, image processing, or text control.

The input/output interface 150, for example, may function as an interface that may transfer instructions or data input from a user or another external device to the other component(s) of the electronic device 101. Furthermore, the input/output interface 150 may output instructions or data received from the other element(s) of the electronic device 101 to a user or another external device.

Examples of the display 160 may include a liquid crystal display (LCD), a light-emitting diode (LED) display, an organic LED (OLED) display, a microelectromechanical systems (MEMS) display, and an electronic paper display. The display 160 may display various types of contents (e.g., text, images, videos, icons, or symbols) for users. The display 160 may include a touch screen, and may receive, for example, a touch, gesture, proximity, or hovering input by using an electronic pen or a part of the user's body.

The communication module 170, for example, may set communication between the electronic device 101 and an external device (e.g., a first external electronic device 102, a second external electronic device 104, or a server 106). For example, the communication module 170 may be connected to a network 162 through wireless or wired communication to communicate with the external device (e.g., the second external electronic device 104 or the server 106).

The wireless communication may use at least one of, for example, long term evolution (LTE), LTE-advanced (LTE-A), code division multiple access (CDMA), wideband CDMA (WCDMA), universal mobile telecommunications system (UMTS), wireless broadband (WiBro), and global system for mobile communications (GSM), as a cellular communication protocol. In addition, the wireless communication may include, for example, short range communication 164. The short range communication 164 may include, for example, at least one of Wi-Fi, Bluetooth, near field communication (NFC), global navigation satellite system (GNSS), and the like. The GNSS may include at least one of, for example, a GPS, a global navigation satellite system (GLONASS), a BeiDou Navigation Satellite System (hereinafter referred to as "BeiDou"), and a European global satellite-based navigation system (Galileo), according to a use area, a bandwidth, and the like. Hereinafter, the "GPS" may be interchangeably used with the "GNSS" in the present disclosure. The wired communication may include at least one of, for example, a universal serial bus (USB), a high definition multimedia interface (HDMI), recommended standard 232 (RS-232), and a plain old telephone service (POTS). The network 162 may include at least one of a communication network, such as a computer network (e.g., a local area network (LAN) or a wide area network (WAN)), the Internet, and a telephone network.

Each of the first external electronic device 102 and the second external electronic device 104 may be of a type that is identical to, or different from, that of the electronic device 101. According to an embodiment of the present disclosure, the server 106 may include a group of one or more servers. According to various embodiments of the present disclosure, all or some of the operations performed in the electronic device 101 may be performed in another electronic device or a plurality of electronic devices (e.g., the first external electronic device 102 or the second external electronic device 104, or the server 106). According to an embodiment of the present disclosure, when the electronic device 101 has to perform some functions or services automatically or by request, the electronic device 101 may make a request for performing at least some functions relating thereto to another device (e.g., the first external electronic device 102 or the second external electronic device 104 or the server 106) instead of, or in addition to, performing the functions or services by itself. Another electronic device (e.g., the first external electronic device 102 or the second external electronic device 104, or the server 106) may execute the requested functions or the additional functions, and may deliver a result of the execution to the electronic device 101. The electronic device 101 may process the received result as it is or additionally, and may provide the requested functions or services. To this end, for example, cloud computing, distributed computing, or client-server computing technology may be used.

Figure 2:
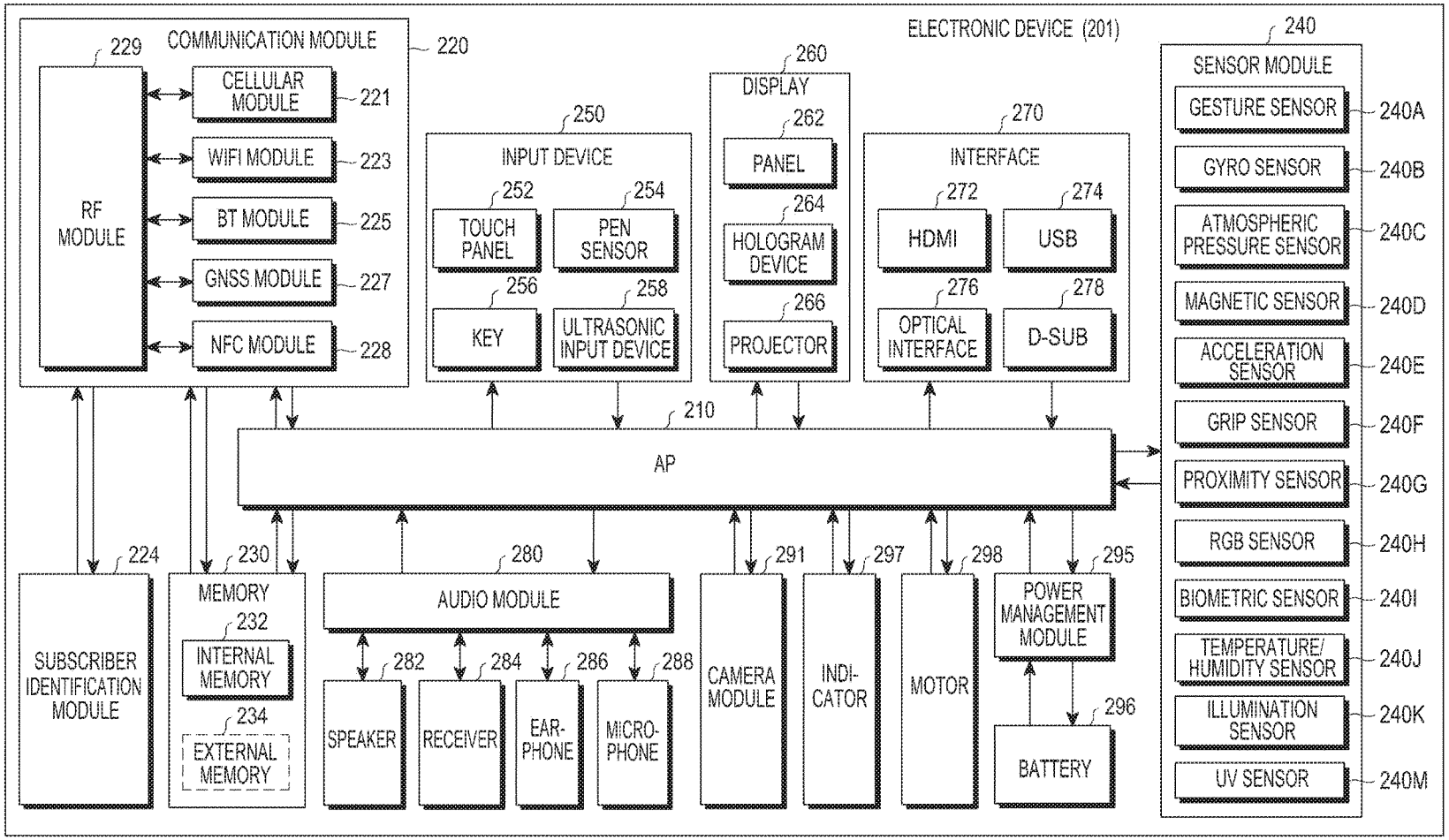
FIG. 2 is a block diagram of an electronic device according to various embodiments of the present disclosure.

FIG. 2 is a block diagram of an electronic device according to various embodiments of the present disclosure.

Referring to FIG. 2, an electronic device 201 may include a part, or the entirety, of the electronic device 101 illustrated in FIG. 1. The electronic device 201 may include at least one processor 210 (e.g., an AP), a communication module 220, a subscriber identification module (SIM) 224, a memory 230, a sensor module 240, an input device 250, a display 260, an interface 270, an audio module 280, a camera module 291, a power management module 295, a battery 296, an indicator 297, and a motor 298.

The processor 210 may control a plurality of hardware or software components connected to the processor 210 by driving an operating system or an application program, and may perform various data processing and calculations. The processor 210 may be embodied as, for example, a system on chip (SoC). According to an embodiment of the present disclosure, the processor 210 may further include a graphics processing unit (GPU) and/or an image signal processor. The processor 210 may include at least some (e.g., a cellular module 221) of the components illustrated in FIG. 2. The processor 210 may load, into a volatile memory, instructions or data received from at least one (e.g., a non-volatile memory) of the other components and may process the loaded instructions or data, and may store various data in a non-volatile memory.

The communication module 220 may have a configuration that is equal or similar to that of the communication module 170 of FIG. 1. The communication module 220 may include, for example, the cellular module 221, a Wi-Fi module 223, a Bluetooth module 225, a GNSS module 227, an NFC module 228, and a radio frequency (RF) module 229.

The cellular module 221 may provide a voice call, a video call, a text message service, or an Internet service through, for example, a communication network. According to an embodiment of the present disclosure, the cellular module 221 may distinguish and authenticate the electronic device 201 within a communication network using a SIM (e.g., the SIM card 224). According to an embodiment of the present disclosure, the cellular module 221 may perform at least some of the functions that the processor 210 may provide. According to an embodiment of the present disclosure, the cellular module 221 may include a CP.

The Wi-Fi module 223, the Bluetooth module 225, the GNSS module 227, or the NFC module 228 may include, for example, a processor that processes data transmitted and received through a corresponding module. According to an embodiment of the present disclosure, at least some (e.g., two or more) of the cellular module 221, the Wi-Fi module 223, the Bluetooth module 225, the GNSS module 227, and the NFC module 228 may be included in one integrated chip (IC) or IC package.

The RF module 229 may transmit/receive, for example, a communication signal (e.g., an RF signal). The RF module 229 may include, for example, a transceiver, a power amp module (PAM), a frequency filter, a low noise amplifier (LNA), an antenna, and the like. According to an embodiment of the present disclosure, at least one of the cellular module 221, the Wi-Fi module 223, the Bluetooth module 225, the GNSS module 227, and the NFC module 228 may transmit and receive RF signals through a separate RF module.

The SIM 224 may include, for example, a card containing a subscriber identity module and/or an embedded SIM, and may contain unique identification information (e.g., an integrated circuit card identifier (ICCID)) or subscriber information (e.g., an international mobile subscriber identity (IMSI)).

The memory 230 (e.g., the memory 130) may include, for example, an embedded memory 232 or an external memory 234. The embedded memory 232 may include at least one of, for example, a volatile memory (e.g., a dynamic random access memory (DRAM), a static RAM (SRAM), a synchronous DRAM (SDRAM), and the like) and a non-volatile memory (e.g., a one-time programmable read only memory (OTPROM), a PROM, an erasable and programmable ROM (EPROM), an electrically erasable and programmable ROM (EEPROM), a flash memory (e.g., a NAND flash memory or a NOR flash memory), a hard driver, or a solid state drive (SSD).

The external memory 234 may further include a flash drive, for example, a compact flash (CF), a secure digital (SD), a micro-SD, a mini-SD, an extreme digital (xD), a memory stick, and the like. The external memory 234 may be functionally and/or physically connected to the electronic device 201 through various interfaces.

The sensor module 240 may measure a physical quantity or detect an operation state of the electronic device 201, and may convert the measured or detected information into an electric signal. The sensor module 240 may include, for example, at least one of a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., a red, green, blue (RGB) sensor), a biometric sensor 240I, a temperature/humidity sensor 240J, an illuminance sensor 240K, and an ultraviolet (UV) sensor 240M. Additionally or alternatively, the sensor module 240 may include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling one or more sensors included therein. According to an embodiment of the present disclosure, the electronic device 201 may further include a processor that is configured to control the sensor module 240, as a part of the AP 210 or separately from the AP 210, and may control the sensor module 240 while the AP 1410 is in a sleep state.

The input device 250 may include, for example, a touch panel 252, a (digital) pen sensor 254, a key 256, and an ultrasonic input unit 258. The touch panel 252 may use at least one of, for example, a capacitive scheme, a resistive scheme, an infrared scheme, and an ultrasonic scheme. Further, the touch panel 252 may further include a control circuit. The touch panel 252 may further include a tactile layer and provide a tactile reaction to a user.

The (digital) pen sensor 254 may include, for example, a recognition sheet, which is a part of the touch panel or is separated from the touch panel. The key 256 may include, for example, a physical button, an optical key or a keypad. The ultrasonic input device 258 may determine data by detecting an ultrasonic wave generated by an input unit, using a microphone (e.g., the microphone 288) of the electronic device 201.

The display 260 (e.g., the display 160) may include a panel 262, a hologram device 264 or a projector 266. The panel 262 may include a configuration that is identical or similar to that of the display 160 illustrated in FIG. 1. The panel 262 may be embodied to be, for example, flexible, transparent, or wearable. The panel 262 and the touch panel 252 may be embodied as one module. The hologram 264 may show a three dimensional image in the air by using an interference of light. The projector 266 may display an image by projecting light onto a screen. The screen may be located, for example, inside or outside the electronic device 201. According to an embodiment of the present disclosure, the display 260 may further include a control circuit for controlling the panel 262, the hologram device 264, or the projector 266.

The interface 270 may include, for example, an HDMI 272, a USB 274, an optical interface 276, or a D-subminiature (D-sub) 278. The interface 270 may be included in, for example, the communication module 170 illustrated in FIG. 1. Additionally or alternatively, the interface 270 may, for example, include a mobile high-definition link (MHL) interface, an SD card/multi-media card (MMC) interface, or an infrared data association (IrDA) standard interface.

The audio module 280 may bilaterally convert, for example, a sound and an electric signal. At least some components of the audio module 280 may be included in, for example, the input/output interface 150 illustrated in FIG. 1. The audio module 280 may process sound information that is input or output through, for example, a speaker 282, a receiver 284, earphones 286, the microphone 288, and the like.

The camera module 291 is a device that may photograph a still image and a dynamic image. According to an embodiment of the present disclosure, the camera module 291 may include one or more image sensors (e.g., a front sensor or a back sensor), a lens, an image signal processor (ISP) or a flash (e.g., LED or xenon lamp).

The power management module 295 may manage, for example, power of the electronic device 201. According to an embodiment of the present disclosure, the power management module 295 may include a power management IC (PMIC), a charger IC, or a battery or fuel gauge. The PMIC may use a wired and/or wireless charging method. Examples of the wireless charging method may include, for example, a magnetic resonance method, a magnetic induction method, an electromagnetic method, and the like. Additional circuits (e.g., a coil loop, a resonance circuit, a rectifier,) for wireless charging may be further included. The battery gauge may measure, for example, a residual quantity of the battery 296, and a voltage, a current, or a temperature during charging. The battery 296 may include, for example, a rechargeable battery and/or a solar battery.

The indicator 297 may indicate a particular state (e.g., a booting state, a message state, a charging state, and the like) of the electronic device 201 or a part (e.g., the processor 210) of the electronic device 201. The motor 298 may convert an electric signal into mechanical vibrations, and may generate a vibration, a haptic effect, and the like. Although not illustrated, the electronic device 201 may include a processing device (e.g., a GPU) for supporting a mobile TV. The processing device for supporting the mobile TV may, for example, process media data according to a certain standard such as digital multimedia broadcasting (DMB), digital video broadcasting (DVB), mediaFLO™, and the like.

Each of the above-described component elements of hardware according to the present disclosure may be configured with one or more components, and the names of the corresponding component elements may vary based on the type of electronic device. The electronic device according to various embodiments of the present disclosure may include at least one of the aforementioned elements. Some elements may be omitted or other additional elements may be further included in the electronic device. Further, some of the components of the electronic device according to the various embodiments of the present disclosure may be combined to form a single entity, and thus, may equivalently execute functions of the corresponding elements prior to the combination.

Figure 3:
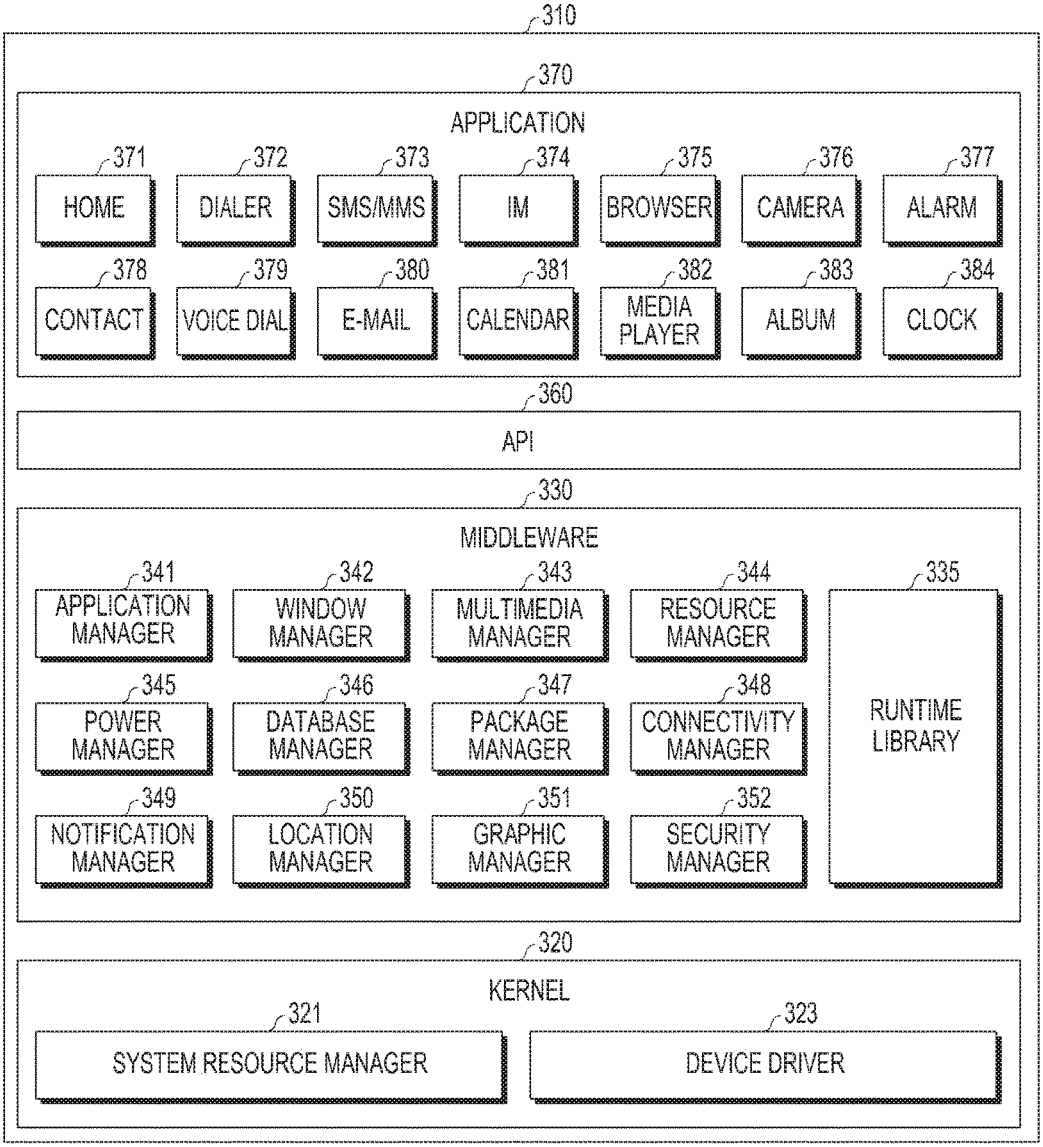
FIG. 3 is a block diagram of a program module according to various embodiments of the present disclosure.

FIG. 3 is a block diagram of a program module according to various embodiments of the present disclosure.

Referring to FIG. 3, according to an embodiment of the present disclosure, a program module 310 (e.g., the program 140) may include an operating system (OS) for controlling resources related to an electronic device (e.g., the electronic device 101) and/or various applications (e.g., the application programs 147) executed in the operating system. The operating system may be, for example, Android, iOS, Windows, Symbian, Tizen, Bada, and the like.

The program module 310 may include a kernel 320, middleware 330, an API 360, and/or applications 370. At least a part of the program module 310 may be preloaded on the electronic device, or may be downloaded from an external electronic device (e.g., the first external electronic device 102 or the second external electronic device 104, or the server 106).

The kernel 320 (e.g., the kernel 141 of FIG. 1) may include, for example, a system resource manager 321 and/or a device driver 323. The system resource manager 321 may control, assign, or collect system resources. According to an embodiment of the present disclosure, the system resource manager 321 may include a process manager, a memory manager, a file system manager, and the like. The device driver 323 may include, for example, a display driver, a camera driver, a Bluetooth driver, a shared memory driver, a USB driver, a keypad driver, a Wi-Fi driver, an audio driver, or an inter-process communication (IPC) driver.

The middleware 330 may provide a function required by the applications 370 in common or may provide various functions to the applications 370 through the API 360 so that the applications 370 may efficiently use limited system resources within the electronic device. According to an embodiment of the present disclosure, the middleware 330 (e.g., the middleware 143) may include, for example, at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include, for example, a library module that a compiler uses in order to add new functions through a programming language while the applications 370 are executed. The runtime library 335 may perform input/output management, memory management, or a function for an arithmetic function.

The application manager 341 may, for example, manage the life cycle of at least one of the applications 370. The window manager 342 may manage graphical user interface (GUI) resources used on a screen. The multimedia manager 343 may identify formats that are required for the reproduction of various media files and encode or decode a media file using a codec suitable for a corresponding format. The resource manager 344 may manage resources of at least one of the applications 370, such as a source code, a memory, a storage space, and the like.

The power manager 345 may operate together with, for example, a basic input/output system (BIOS), and the like, to manage a battery or power and may provide power information required for the operation of the electronic device. The database manager 346 may generate, search for, or change a database to be used in at least one of the applications 370. The package manager 347 may manage the installation or updating of an application distributed in the form of a package file.

The connectivity manager 348 may manage a wireless connection such as, for example, Wi-Fi, Bluetooth, and the like. The notification manager 349 may display or report an event, such as an arrival message, an appointment, proximity notification, and the like, in such a manner so as not to disturb a user. The location manager 350 may manage location information of the electronic device. The graphic manager 351 may manage a graphic effect to be provided to a user and a user interface relating to the graphic effect. The security manager 352 may provide all security functions required for system security, user authentication, and the like. According to an embodiment of the present disclosure, when the electronic device (e.g., the electronic device 101) has a phone call function, the middleware 330 may further include a telephony manager for managing a voice call function or a video call function of the electronic device.

The middleware 330 may include a middleware module that forms combinations of various functions of the above described components. The middleware 330 may provide a module specialized for each type of OS in order to provide a differentiated function. Furthermore, the middleware 330 may dynamically remove some of the existing components, or may add new components.

The API 360 (e.g., the API 145) is, for example, a set of API programming functions, and may be provided with a different configuration according to an OS. For example, in the case of Android or iOS, one API set may be provided for each platform, and in the case of Tizen, two or more API sets may be provided for each platform.

The applications 370 (e.g., the application programs 147) may include, for example, one or more applications that may provide functions, such as a home application 371, a dialer application 372, a short message service (SMS)/multimedia message service (MMS) application 373, an instant message (IM) application 374, a browser application 375, a camera application 376, an alarm application 377, contacts application 378, a voice dialer application 379, an e-mail application 380, a calendar application 381, a media player application 382, an album application 383, a clock application 384, a health care application (e.g., measure exercise quantity or blood sugar), and environment information (e.g., atmospheric pressure, humidity, temperature information, and the like).

According to an embodiment of the present disclosure, the applications 370 may include an application (hereinafter, referred to as an "information exchange application" for convenience of description) that supports exchanging information between the electronic device (e.g., the electronic device 101) and an external electronic device (e.g., the first external electronic device 102 or the second external electronic device 104). The application associated with exchanging information may include, for example, a notification relay application for notifying an external electronic device of certain information or a device management application for managing an external electronic device.

For example, the notification relay application may include a function of transferring, to an external electronic device (e.g., the first external electronic device 102 or the second external electronic device 104), notification information generated from other applications of the electronic device (e.g., an SMS/MMS application, an e-mail application, a health management application, an environmental information application, and the like). Further, the notification relay application may receive notification information from, for example, an external electronic device and provide the received notification information to a user.

For example, the device management application may manage (e.g., install, delete, or update) at least one function of an external electronic device (e.g., the first external electronic device 102 or the second external electronic device 104) communicating with the electronic device (e.g., a function of turning on/off the external electronic device itself (or some components) or a function of adjusting luminance (or a resolution) of the display), applications operating in the external electronic device, or services provided by the external electronic device (e.g., a call service and a message service).

According to an embodiment of the present disclosure, the application 370 may include an application (e.g., a health care application of a mobile medical device, and the like) designated according to an attribute of the external electronic device (e.g., the first external electronic device 102 or the second external electronic device 104). According to an embodiment of the present disclosure, the application 370 may include an application received from the external electronic device (e.g., the server 106, or the first external electronic device 102 or the second external electronic device 104). According to an embodiment of the present disclosure, the applications 370 may include a preloaded application or a third party application that can be downloaded from the server). Names of the elements of the program module 310, according to the above-described embodiments of the present disclosure, may change depending on the type of OS.

According to various embodiments of the present disclosure, at least some of the program module 310 may be implemented in software, firmware, hardware, or a combination of two or more thereof. At least a part of the program module 310 may be implemented (e.g., executed), for example, by a processor (e.g., the processor 120). At least some of the program module 310 may include, for example, a module, a program, a routine, a set of instructions, and/or a process for performing one or more functions.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented.

For example, the "module" according to the present disclosure may include at least one of an application-specific IC (ASIC) chip, a field-programmable gate array (FPGA), and a programmable-logic device for performing operations which has been known or are to be developed hereinafter.

According to various embodiments of the present disclosure, at least some of the devices (for example, modules or functions thereof) or the method (for example, operations) according to the present disclosure may be implemented by a command stored in a computer-readable storage medium in a programming module form. The instruction, when executed by a processor (e.g., the processor 120), may cause the one or more processors to execute the function corresponding to the instruction. The computer-readable storage medium may be, for example, the memory 130.

Certain aspects of the present disclosure can also be embodied as computer readable code on a non-transitory computer readable recording medium. A non-transitory computer readable recording medium is any data storage device that can store data which can be thereafter read by a computer system. Examples of the non-transitory computer readable recording medium include a Read-Only Memory (ROM), a Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing the present disclosure can be easily construed by programmers skilled in the art to which the present disclosure pertains.

At this point it should be noted that the various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure as described above. Alternatively, one or more processors operating in accordance with stored instructions may implement the functions associated with the various embodiments of the present disclosure as described above. If such is the case, it is within the scope of the present disclosure that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present disclosure can be easily construed by programmers skilled in the art to which the present disclosure pertains.

The programming module according to the present disclosure may include one or more of the aforementioned components or may further include other additional components, or some of the aforementioned components may be omitted. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added. Various embodiments disclosed herein are provided merely to easily describe technical details of the present disclosure and to help the understanding of the present disclosure, and are not intended to limit the scope of the present disclosure. Accordingly, the scope of the present disclosure should be construed as including all modifications or various other embodiments based on the technical idea of the present disclosure.

Figure 4:
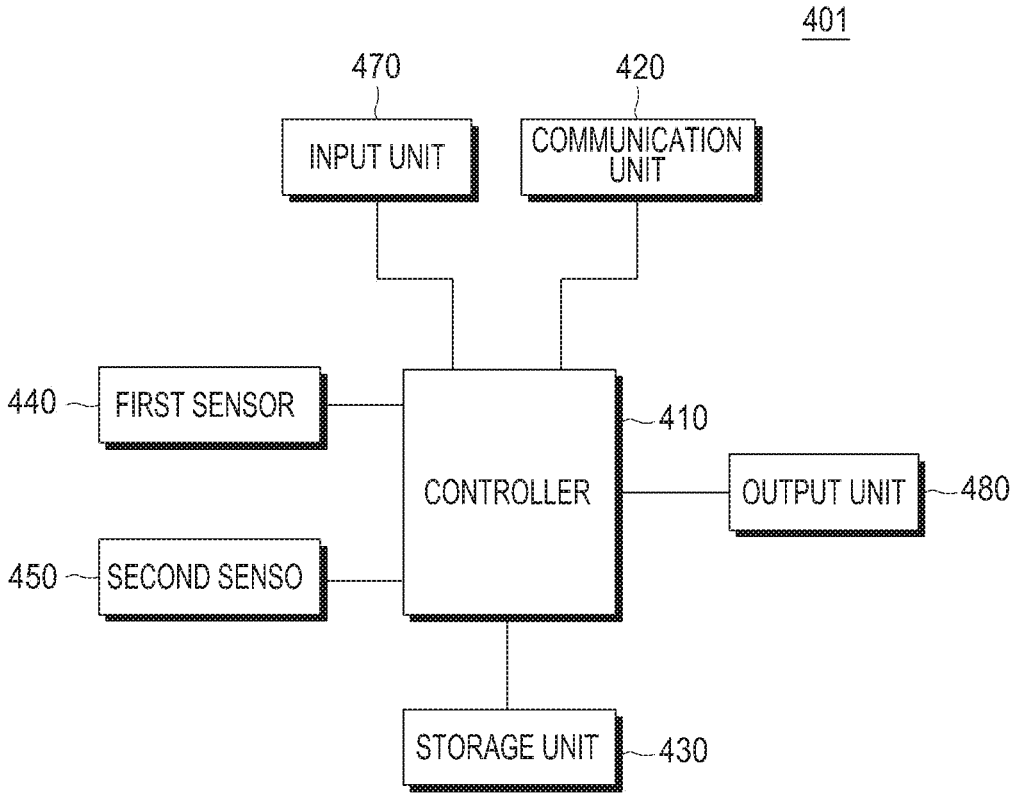
FIG. 4 is a block diagram illustrating a configuration of an electronic device according to various embodiments of the present disclosure.
Figure 5A:
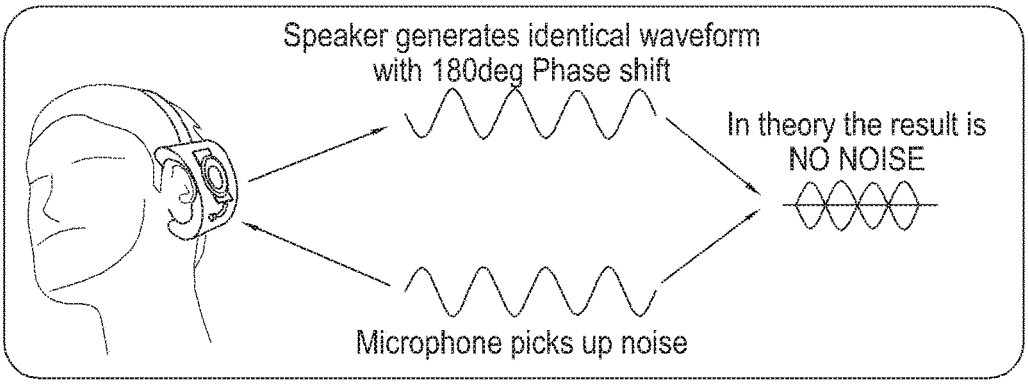
FIGS. 5A and 5B illustrate noise being generated by a physical vibration or abnormal input in an electronic device according to various embodiments of the present disclosure.
Figure 5B:
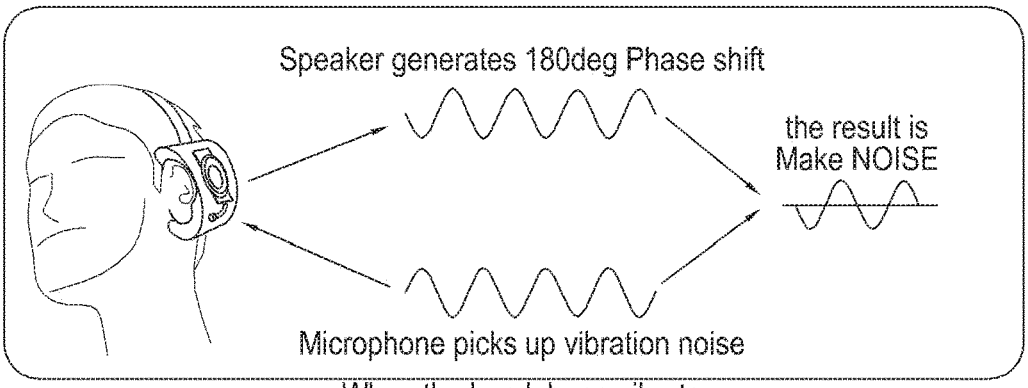

FIG. 4 is a block diagram illustrating a configuration of an electronic device according to various embodiments of the present disclosure. FIGS. 5A and 5B illustrate noise being generated by a physical vibration or an abnormal input in an electronic device according to various embodiments of the present disclosure.

Referring to FIG. 4, an electronic device 401, according to various embodiments of the present disclosure, may include, for example, a part or the entirety of the electronic device 201 of FIG. 2. The electronic device 401 may be of various types of devices to which the active noise cancellation (ANC) technology is applied, which may output an acoustic signal to the outside and may actively reduce an acoustic noise from the surroundings. The electronic device 401 may representatively include earphones, a headphone, a headset, and the like, which is worn by, particularly, ears and outputs an acoustic signal, and may be configured to include a controller 410, a communication unit 420, a storage unit 430, a first sensor 440, a second sensor 450, an input unit 470, and an output unit 480.

The communication unit 420 may execute data communication by connecting a communication session with another electronic device. For example, the communication unit 420 may include a part or the entirety of the communication module 220 of FIG. 2. The communication unit 420 may communicate with another electronic device by being connected with a network through wireless communication. Wireless communication may include, for example, at least one of Wi-Fi, Bluetooth, NFC, GNSS or cellular communication (e.g., LTE, LTE-A, CDMA, WCDMA, UMTS, WiBro or GSM, and the like). In addition, the communication unit 420 may include at least one of, for example, a USB, an HDMI, RS-232, and a POTS, as wired communication.

The storage unit 430 may include a volatile memory and/or a non-volatile memory. The storage unit 430 may include a part, or the entirety, of the memory 230 of FIG. 2. The storage unit 430 may store instructions or data relevant to at least one other component of the electronic device 401. The storage unit 430 may store signal or data input/output to correspond to operations of the controller 410, the communication unit 420, the first sensor 440, the second sensor 450, the input unit 470, and the output unit 480, under the control of the controller 410. The storage unit 430 may store a control program and applications for the control of the electronic device 401 or the controller 410.

The first sensor 440 may include a sensor (e.g., a vibration detecting sensor) that is capable of converting vibrations into an electric or electronic signal. For example, the first sensor 440 may include a part, or the entirety, of the sensor module 240 of FIG. 2. The first sensor 440 may include various devices that are capable of converting vibrations into an electric signal. According to various embodiments of the present disclosure, at least one of an acceleration sensor and an acoustic isolation microphone may be included.

The second sensor 450 may include a sensor (e.g., a microphone) that is capable of converting an acoustic signal into an electric or electronic signal. For example, the second sensor 450 may include the microphone 288 of FIG. 2. The second sensor 450 may obtain noise occurring around the electronic device 401, and a plurality of second sensors may be formed around the electronic device 401.

The input unit 470, for example, may include a part, or the entirety, of the input device 250 of FIG. 2, and may include the touch panel 252, the key 256, or the ultrasonic input device 258. The touch panel 252 may use at least one of, for example, a capacitive type, a resistive type, an infrared type, and an ultrasonic type. Further, the touch panel may further include a control circuit. The touch panel may further include a tactile layer to provide a tactile reaction to a user. The key may include, for example, a physical button, an optical key, or a keypad. In addition, the input unit 470 may include a microphone used for the purpose of a voice call, and may be configured in a form including a microphone and a key button together. In addition, the input unit 470 may receive an acoustic signal that is input in a manner of wired communication, and may output the input acoustic signal to the outside through the output unit 480.

The output unit 480 may include a speaker through which an acoustic signal is output to the outside. For example, the output unit 480 may include a part, or the entirety, of the audio module 280 of FIG. 2. The output unit 480 may output an acoustic signal through a speaker so that the acoustic signal is output acoustically.

The electronic device 410, for example, may include a part, or the entirety, of the processor 210 of FIG. 2. The processor 410 may include one or more of a CPU, an AP, and a CP. The controller 410 may process at least some of information obtained from other components of the electronic device 401 (e.g., the communication unit 420, the storage unit 430, the first sensor 440*a* and 440*b*, the second sensor 450, the input unit 470, the output unit 480, and the like), and may provide the same to a user in various methods. According to various embodiments of the present disclosure, the controller 410 may control all the components of the electronic device 401. More particularly, the controller 410 may support an ANC function, and may be embodied as hardware, software, or a combination thereof. For example, the controller 410 may be an ANC circuit. According to various embodiments of the present disclosure, the controller 410 may cancel noise that may be generated by a physical vibration or an abnormal input in a process of providing the ANC function.

Referring to FIG. 5A, normally, the ANC function in the electronic device may generate a noise cancellation signal by shifting, by 180 degrees, a phase of noise obtained through a microphone (e.g., the microphone 450 of FIG. 4) from the surroundings. The generated noise cancellation signal may be output through a speaker (e.g., the speaker 480 of FIG. 4). The noise occurring around the electronic device and the noise cancellation signal output through the speaker may execute destructive interference, and noise arriving at the ears of a user may be reduced.

However, referring to FIG. 5B, when a physical vibration is applied around the electronic device, a microphone (e.g., the microphone 450 of FIG. 4) may obtain noise that is not actually recognized by acoustic sense due to the physical vibration around the electronic device. Even in this instance, the phase of the obtained noise is shifted by 180 degrees and a noise cancellation signal is generated. The generated noise cancellation signal may be output through a speaker (e.g., the speaker 480 of FIG. 4). In this instance, the physical vibration occurring around the electronic device is merely recognized by the microphone but is not actually recognized by acoustic sense and thus, the noise cancellation signal that is output through the speaker may not be removed by the destructive interference but may arrive at the ears of the user. Due to the physical vibration occurring around the electronic device, the noise that is not actually recognized by acoustic sense but is recognized by only the microphone may be newly generated as an acoustically recognized noise (a noise cancellation signal), which is a drawback.

According to various embodiments of the present disclosure, to remove the situation in which the ANC function newly generates an acoustically recognized noise from the noise that is not actually recognized by acoustic sense, due to a physical vibration or an abnormal input in the electronic device, the electronic device adds the first sensor 440, that is, a vibration sensor, so as to deactivate the ANC function at a point when vibrations occur, and prevents noise from being generated by the physical vibration or abnormal input.

According to various embodiments of the present disclosure, the controller 410 generates a first signal by detecting vibrations occurring around the electronic device 401 using the first sensor 440, determines whether the generated first signal satisfies a selected condition, when the first signal satisfies the selected condition, generates a second signal by obtaining noise occurring around the electronic device 401 using the second sensor 450, and generates an acoustic signal to be output through the output unit 480 based on the generated second signal. In addition, when the first signal does not satisfy the selected condition, the controller 410 may generate an acoustic signal to be output through the output unit 480 irrespective of the second signal. Here, the selected condition (or certain condition) may be a case in which the maximum value, or an average value of at least some of the first signal, is less than a threshold value. Alternatively, the selected condition (or certain condition) may be a case in which the maximum value, or an average value of the strength of at least some of the first signal, is less than a threshold value. The selected condition may be designated by a user, or a certain condition may be included in an electronic device. For example, the controller 410 may generate the first signal indicating the level of vibration by detecting vibrations occurring around the electronic device 401 using the first sensor 440 (e.g., a vibration detecting sensor). In this instance, the first signal may be a physical vibration, for example, a vibration on the surface of a road when a user gets in a vehicle, a vibration of an engine, delivered from a vehicle when a headphone is in contact with the vehicle, an up-and-down vibration generated when a user walks, and the like. When the selected condition is not satisfied as the physical vibration is delivered, an acoustic signal to be output through the output unit 480 may be generated irrespective of the second signal that is generated by obtaining noise from surroundings for the ANC function. The output acoustic signal may be a signal from which noise is not cancelled since the ANC function is deactivated.

According to various embodiments of the present disclosure, the controller 410 generates a first signal by detecting vibrations occurring around the electronic device 401 using the first sensor 440, generates a second signal by obtaining noise occurring around the electronic device 401 using the second sensor 450, and generates an acoustic signal to be output through the output unit 480 based on the first signal and the second signal. For example, the controller 410 may remove a vibration frequency component of the first signal from the second signal. The controller 410 may generate a noise cancellation signal based on the second signal from which the vibration frequency component of the first signal is removed. Subsequently, the controller 410 may compose the generated noise cancellation signal and an acoustic signal to be output through the output unit 480. This may remove the vibration frequency component of the first signal that is generated when the first sensor 440 detects the physical vibration, and thus, may cancel noise in the form that is not recognized by acoustic sense. The noise cancellation signal that is generated based on the second signal may target only the noise that is actually recognized by acoustic sense. Accordingly, the noise may be prevented from being generated by a physical vibration or an abnormal input.

As another example, the controller 410 may adjust an input gain of the second signal based on the first signal, generate a noise cancellation signal based on the second signal of which the input gain is adjusted, and compose the generated noise cancellation signal and an acoustic signal to be output through the output unit 480. The input gain of the second signal may be adjusted based on the first signal that is generated when the first sensor 440 detects a physical vibration, and thus, the effect from noise that is not actually recognized by acoustic sense may be minimized. Accordingly, noise may be prevented from being generated by a physical vibration or an abnormal input, from the noise cancellation signal generated based on the second signal.

According to various embodiments of the present disclosure, the controller 410 may transmit, to an external electronic device, a first signal generated by vibrations occurring around the electronic device 401 and a second signal generated by noise occurring around the electronic device 401, using the communication unit 420. The external electronic device may determine whether to activate or deactivate an ANC function based on the received first and second signals. This enables the signal processing for the ANC function to be executed in an external electronic device (e.g., a smart phone) that has a relatively higher performance processor when compared to the electronic device 401 (e.g., a headphone or earphones). In this instance, an application that supports the ANC function may be installed in the external electronic device, and the external electronic device may turn on/off the ANC function using the installed application.

An electronic device, according to an embodiment of the present disclosure, may include a speaker, at least one microphone, at least one sensor, and a control circuit that is electrically connected with the speaker, the at least one microphone, and the at least one sensor, wherein the control circuit executes: generating a first signal by detecting vibrations occurring around the electronic device using the at least one sensor, determining whether the generated first signal satisfies a selected condition, generating a second signal by obtaining noise occurring around the electronic device using the at least one microphone when the first signal satisfies the selected condition, and generating an acoustic signal to be output through the speaker based on the generated second signal, and generating an acoustic signal to be output through the speaker irrespective of the second signal when the first signal does not satisfy the selected condition.

According to an embodiment of the present disclosure, the at least one sensor may include a vibration sensor that is capable of converting vibrations into an electric signal.

According to an embodiment of the present disclosure, the at least one microphone may be disposed in the front of the speaker or around the electronic device, and the at least one sensor may be disposed around the at least one microphone or the electronic device.

According to an embodiment of the present disclosure, the selected condition may include a case in which a maximum value or an average value of at least some of the first signal is less than a threshold value.

According to an embodiment of the present disclosure, the control circuit may generate a noise cancellation signal based on the second signal when the selected condition is satisfied, and may compose the generated noise cancellation signal and an acoustic signal to be output through the speaker.

An electronic device according to an embodiment of the present disclosure may include a speaker, at least one microphone, at least one sensor, and a control circuit that is electrically connected with the speaker, the at least one microphone, and the at least one sensor, wherein the control circuit executes generating a first signal by detecting vibrations occurring around the electronic device using the at least one sensor, generating a second signal by obtaining noise occurring around the electronic device using the at least one microphone, and generating an acoustic signal to be output through the speaker based on the first signal and the second signal.

According to an embodiment of the present disclosure, the at least one sensor may include a vibration sensor that is capable of converting vibrations into an electric signal, and the vibration sensor may include at least one of an acceleration sensor and an acoustic isolation microphone.

According to an embodiment of the present disclosure, the at least one microphone may be disposed in the front of the speaker or around the electronic device, and the at least one sensor may be disposed around the at least one microphone or the electronic device.

According to an embodiment of the present disclosure, the control circuit may cancel a vibration frequency component of the first signal from the second signal, generate a noise cancellation signal based on the second signal from which the vibration frequency component of the first signal is removed, and compose the generated noise cancellation signal and an acoustic signal to be output through the speaker.

According to an embodiment of the present disclosure, the control circuit may adjust an input gain of the second signal based on the first signal, generate a noise cancellation signal based on the second signal of which the input gain is adjusted, and compose the generated noise cancellation signal and an acoustic signal to be output through the speaker.

An electronic device, according to an embodiment of the present disclosure, may include: a communication circuit, a speaker, at least one microphone, and a control circuit that is electrically connected with the communication circuit, the speaker, and the at least one microphone, wherein the control circuit executes receiving, using the communication circuit from an external device, a first signal generated from the external device by vibrations occurring around the external device, determining whether the received first signal satisfies a selected condition, when the first signal satisfies the selected condition, generating a second signal by obtaining noise occurring around the electronic device, using the at least one microphone, and generating an acoustic signal to be output through the speaker based on the generated second signal, when the first signal does not satisfy the selected condition, generating an acoustic signal to be output through the speaker, irrespective of the second signal.

An electronic device, according to an embodiment of the present disclosure, may include a speaker, at least one sensor, and a control circuit that is electrically connected with the speaker and the at least one sensor, wherein the control circuit executes generating a first signal by detecting vibrations occurring around the electronic device using the at least one sensor, and generating an acoustic signal to be output through the speaker based on the first signal.

According to an embodiment of the present disclosure, the control circuit may execute: generating a second signal by obtaining noise occurring around the electronic device using at least one microphone, and generating an acoustic signal to be output through the speaker based on the first signal and the second signal.

According to an embodiment of the present disclosure, the control circuit may execute: determining whether the first signal satisfies a selected condition, when the first signal satisfies the selected condition, generating a second signal by obtaining noise occurring around the electronic device using at least one microphone, and generating an acoustic signal to be output through the speaker based on the generated second signal; and when the first signal does not satisfy the selected condition, generating an acoustic signal to be output through the speaker, irrespective of the second signal.

According to an embodiment of the present disclosure, the control circuit may execute receiving, using a communication circuit from an external device, a first signal that is generated from the external device by vibrations occurring around the external device, determining whether the received first signal satisfies a selected condition, when the first signal satisfies the selected condition, generating a second signal by obtaining noise occurring around the electronic device using the at least one microphone, and generating an acoustic signal to be output through the speaker based on the generated second signal, and when the first signal does not satisfy the selected condition, generating an acoustic signal to be output through the speaker, irrespective of the second signal.

Figure 6:
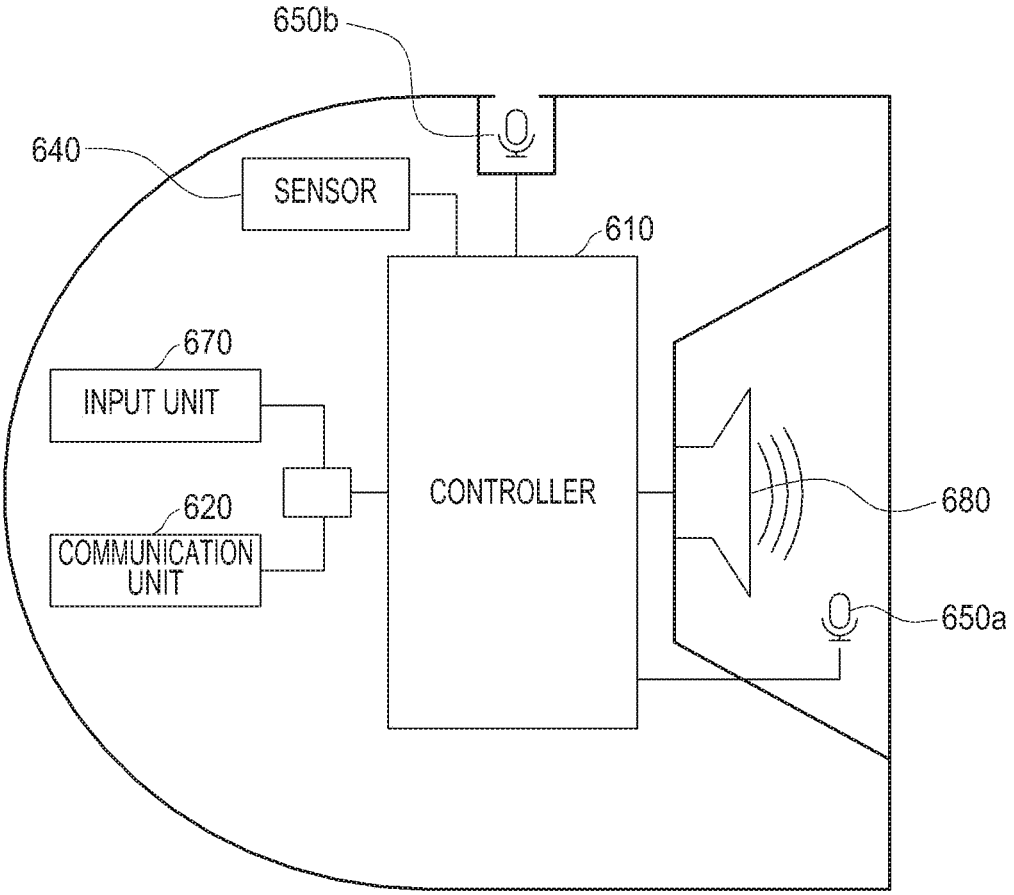
FIG. 6 illustrates an electronic device that is embodied according to an embodiment of the present disclosure.
Figure 7:
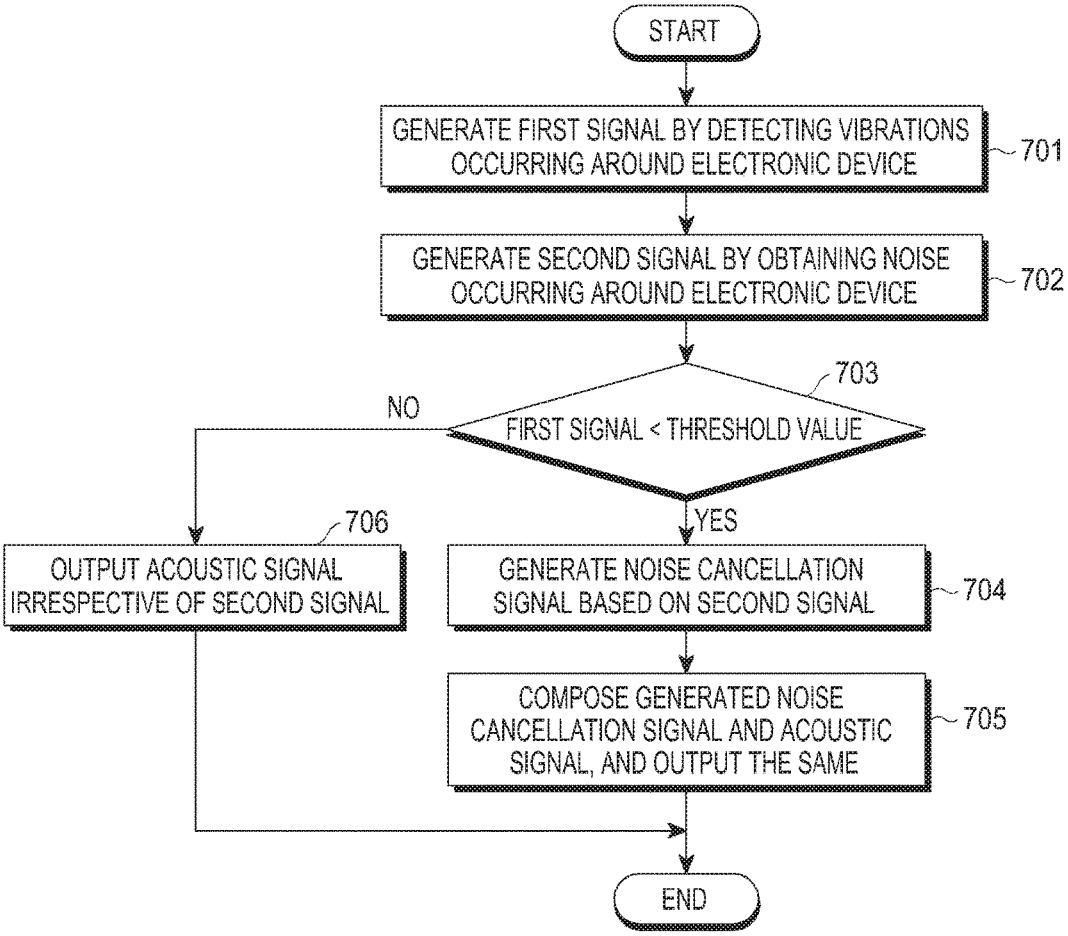
FIG. 7 is a flowchart illustrating a method of cancelling noise using an electronic device according to an embodiment of the present disclosure.

FIG. 6 illustrates an electronic device that is embodied according to an embodiment of the present disclosure. FIG. 7 is a flowchart illustrating a method of cancelling noise using an electronic device according to an embodiment of the present disclosure.

Referring to FIGS. 6 and 7, an electronic device according to an embodiment of the present disclosure may be embodied in the form of a headphone, and may include a controller 610, a sensor 640, a microphone 650*a* and 650*b*, a communication unit 620, an input unit 670, and a speaker 680. The electronic device, according to an embodiment of the present disclosure, may include a part or the entirety of the electronic device 401 of FIG. 4.

The communication unit 620 may receive an acoustic signal from an external electronic device through wireless communication (e.g., Bluetooth), and the input unit 670 may receive an acoustic signal from an external electronic device through wired communication (e.g., the wire of a headphone).

The sensor 640 may include at least one sensor. The sensor 640 may include, for example, a vibration sensor, and may be disposed around the microphone 650*a* and 650*b*, or inside a headphone housing. The sensor 640 may employ various devices that are capable of detecting only an external physical vibration. According to various embodiments of the present disclosure, the sensor 640 may include an acceleration sensor or an acoustic isolation microphone provided in a form that is isolated from the air.

At least one microphone 650*a* and 650*b* may be included. A plurality of microphones 650*a* and 650*b* may be formed around the electronic device, and may include the microphone 650*a* that is disposed in the front of the speaker 680 and the microphone 650*b* that is disposed inside the headphone housing.

The speaker 680 may output an acoustic signal to the outside. The speaker 680 may output an acoustic signal so that a user may acoustically feel the acoustic signal.

The controller 610 may be electrically connected with the sensor 640, the microphone 650*a* and 650*b*, and the speaker 680, and may be embodied as an ANC circuit.

Hereinafter, a method of cancelling noise using an electronic device, according to an embodiment of the present disclosure, will be described as follows.

In operation 701, the electronic device generates a first signal by detecting vibrations occurring around the electronic device using at least one sensor 640.

In operation 702, the electronic device generates a second signal by obtaining noise occurring around the electronic device using a plurality of microphones 650*a* and 650*b*.

In operation 703, the electronic device determines whether the first signal satisfies a selective condition of being less than a certain threshold value. When the first signal is less than the certain threshold value, and a physical vibration from the outside does not exist or is negligible, the electronic device generates a noise cancellation signal based on the second signal in operation 704.

In operation 705, the electronic device composes the generated noise cancellation signal and an acoustic signal to be output through the speaker 680.

Conversely, when the first signal exceeds the certain threshold value and a physical vibration from the outside exists in operation 703, the electronic device generates an acoustic signal to be output through the speaker 680 irrespective of the second signal in operation 706.

Figure 8:
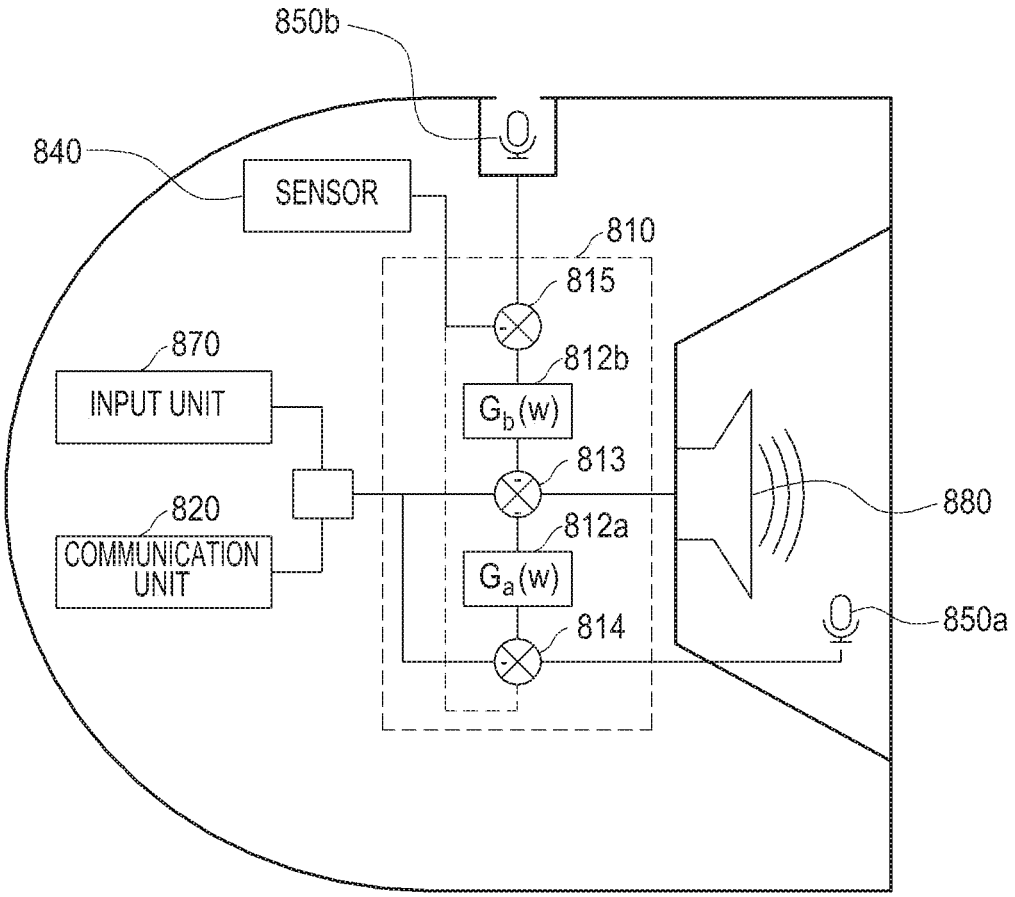
FIG. 8 illustrates an electronic device that is embodied according to an embodiment of the present disclosure.
Figure 9:
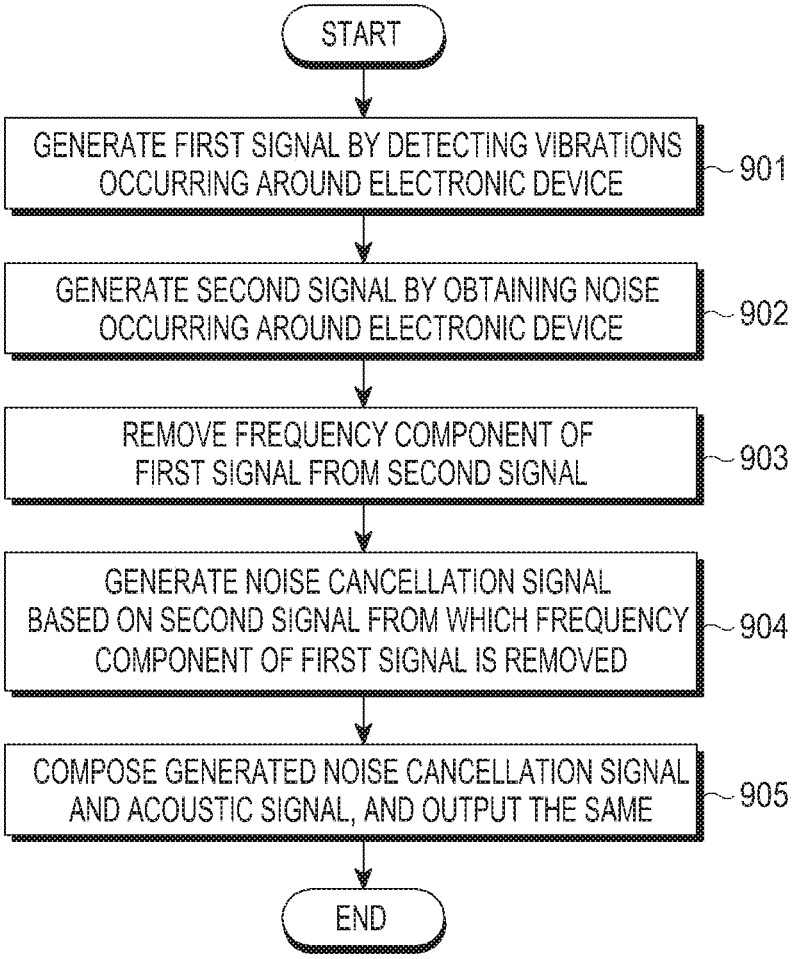
FIG. 9 is a flowchart illustrating a method of cancelling noise using an electronic device according to an embodiment of the present disclosure.
Figure 10:
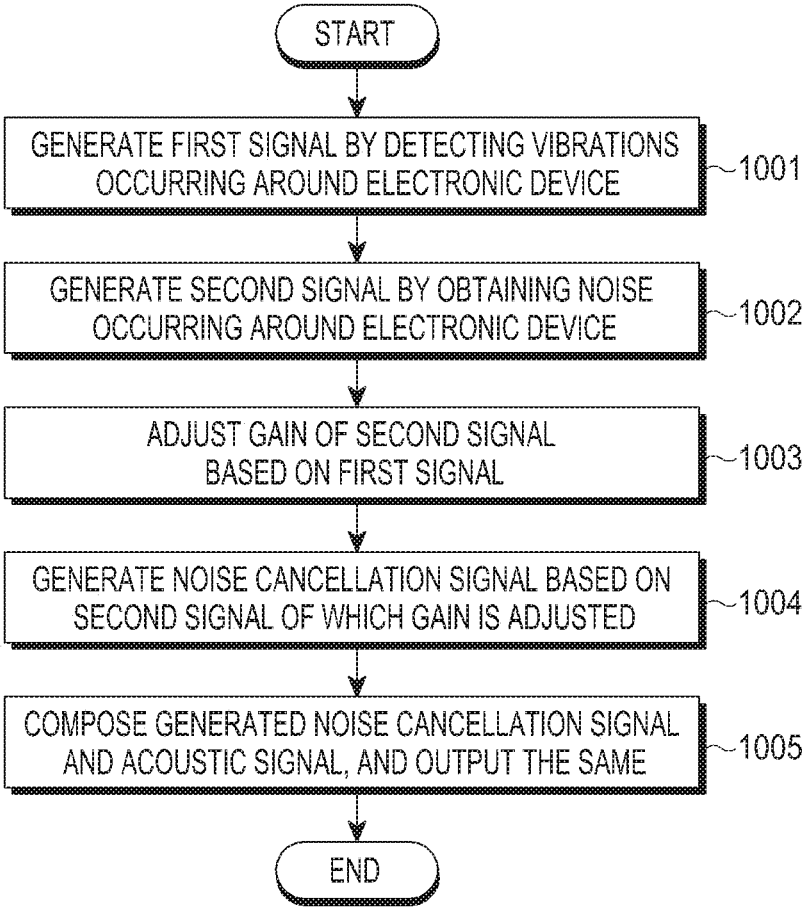
FIG. 10 is a flowchart illustrating a method of cancelling noise using an electronic device according to an embodiment of the present disclosure.

FIG. 8 illustrates an electronic device that is embodied according to an embodiment of the present disclosure. FIG. 9 is a flowchart illustrating a method of cancelling noise using an electronic device according to an embodiment of the present disclosure. FIG. 10 is a flowchart illustrating a method of cancelling noise using an electronic device according to an embodiment of the present disclosure.

Referring to FIG. 8, an electronic device, according to an embodiment of the present disclosure, may be embodied in the form of a headphone, and may include a controller 810, a sensor 840, a microphone 850*a* and 850*b*, a communication unit 820, an input unit 870, and a speaker 880. The electronic device according to an embodiment of the present disclosure may include a part, or the entirety, of the electronic device 401 of FIG. 4.

The communication unit 820 may receive an acoustic signal from an external electronic device through wireless communication (e.g., Bluetooth), and the input unit 870 may receive an acoustic signal from an external electronic device through wired communication (e.g., the wire of a headphone).

The sensor 840 may include at least one sensor. The sensor 840 may include, for example, a vibration sensor, and may be disposed around the microphone 850*a* and 850*b*, or inside a headphone housing. The sensor 840 may employ various devices that are capable of detecting only an external physical vibration. According to various embodiments of the present disclosure, the sensor 840 may include an acceleration sensor or an acoustic isolation microphone provided in a form that is isolated from the air.

At least one microphone 850*a* and 850*b* may be included. A plurality of microphones 850*a* and 850*b* may be formed around the electronic device, and may include the microphone 850*a* that is disposed in the front of the speaker 880 and the microphone 850*b* that is disposed inside the headphone housing.

The speaker 880 may output an acoustic signal to the outside. The speaker 880 may output an acoustic signal so that a user acoustically feels the acoustic signal.

The controller 810 may be electrically connected with the sensor 840, the microphone 850*a* and 850*b*, and the speaker 880, and may be embodied as an ANC circuit. In addition, the controller 810 may include a plurality of phase shifting filters 812*a* and 812*b*, and at least one mixer 813, 814, and 815.

Hereinafter, referring to FIGS. 9 and 10, a method of cancelling noise using an electronic device according to an embodiment of the present disclosure will be described as follows.

Referring to FIG. 9, the electronic device generates a first signal by detecting vibrations occurring around the electronic device using at least one sensor 840 in operation 901.

In operation 902, the electronic device generates a second signal by obtaining noise occurring around the electronic device using a plurality of microphones 850*a* and 850*b*.

In operation 903, the electronic device removes a frequency component of the first signal from the second signal. This is to remove noise that is actually not recognized by acoustic sense by removing the vibration frequency component of the first signal that is generated when a physical vibration is detected.

In operation 904, the electronic device generates a noise cancellation signal based on the second signal from which the vibration frequency component of the first signal is removed. Through the above, the noise cancellation signal is generated based on the second signal from which the noise that is not actually recognized by acoustic sense is removed, and the electronic device may generate a noise cancellation signal that targets only the noise that is actually recognized by acoustic sense.

In operation 905, the electronic device composes the generated noise cancellation signal and an acoustic signal to be output through the speaker 880. Through the above, the noise cancellation signal that targets only the noise that is actually recognized by acoustic sense is generated, and thus, noise that is actually not recognized by acoustic sense may be prevented from being generated by a physical vibration.

Referring to FIG. 10, the electronic device generates a first signal by detecting vibrations occurring around the electronic device using at least one sensor 840 in operation 1001.

In operation 1002, the electronic device generates a second signal by obtaining noise occurring around the electronic device using a plurality of microphones 850*a* and 850*b*.

In operation 1003, the electronic device adjusts an input gain of the second signal based on the first signal. For example, the input gain of the second signal is adjusted based on the first signal that is generated when the physical vibration is detected. Accordingly, the effect from the noise that is not actually recognized by acoustic sense may be minimized. For example, the operation of adjusting the input gain of the second signal may adjust the signal strength of the second signal that is generated by obtaining noise to be decreased based on the signal strength of the first signal that is generated by detecting the physical vibration.

In operation 1004, the electronic device generates a noise cancellation signal based on the second signal of which the input gain is adjusted. Through the above, the noise cancellation signal is generated based on the second signal in which the effect of the noise that is not actually recognized by acoustic sense is minimized, and the electronic device may generate a noise cancellation signal that targets only the noise that is actually recognized by acoustic sense.

In operation 1005, the electronic device composes the generated noise cancellation signal and an acoustic signal to be output through the speaker 880. Through the above, the noise cancellation signal that targets only the noise that is actually recognized by acoustic sense is generated, and thus, noise that actually does not exist may be prevented from being generated by a physical vibration.

A method of cancelling noise using an electronic device, according to an embodiment of the present disclosure, may include generating a first signal by detecting vibrations occurring around the electronic device using at least one sensor, determining whether the generated first signal satisfies a selected condition, when the generated first signal satisfies the selected condition, generating a second signal by obtaining noise occurring around the electronic device using at least one microphone, and generating an acoustic signal to be output through a speaker based on the generated second signal, and when the first signal does not satisfy the selected condition, generating an acoustic signal to be output through the speaker irrespective of the second signal.

According to an embodiment of the present disclosure, the at least one sensor may include a vibration sensor that is capable of converting vibrations into an electric signal, and the vibration sensor includes at least one of an acceleration sensor and an acoustic isolation microphone.

According to an embodiment of the present disclosure, the at least one microphone may be disposed in front of the speaker or around the electronic device, and the at least one sensor may be disposed around at least one microphone or the electronic device.

According to an embodiment of the present disclosure, the selected condition may include a case in which a maximum value or an average value of at least some of the first signal is less than a threshold value.

According to an embodiment of the present disclosure, the operation of generating the acoustic signal may include: when the selected condition is satisfied, generating a noise cancellation signal based on the second signal, and composing the generated noise cancellation signal and an acoustic signal to be output through the speaker.

A method of cancelling noise using an electronic device according to an embodiment of the present disclosure, may include: generating a first signal by detecting vibrations occurring around the electronic device using at least one sensor, generating a second signal by obtaining noise occurring around the electronic device using at least one microphone, and generating an acoustic signal to be output through a speaker based on the first signal and the second signal.

According to an embodiment of the present disclosure, the at least one sensor may include a vibration sensor that is capable of converting vibrations into an electric signal, and the vibration sensor may include at least one of an acceleration sensor and an acoustic isolation microphone.

According to an embodiment of the present disclosure, the at least one microphone may be disposed in the front of the speaker or around the electronic device, and the at least one sensor may be disposed around the at least one microphone or the electronic device.

According to an embodiment of the present disclosure, the operation of generating the acoustic signal may include: removing a vibration frequency component of the first signal from the second signal, generating a noise cancellation signal based on the second signal from which the vibration frequency component of the first signal is removed, and composing the generated noise cancellation signal and an acoustic signal to be output through the speaker.

According to an embodiment of the present disclosure, the operation of generating the acoustic signal may include adjusting an input gain of the second signal based on the first signal, generating a noise cancellation signal based on the second signal of which input gain is adjusted, and composing the generated noise cancellation signal and an acoustic signal to be output through the speaker.

A method of removing noise using an electronic device, according to an embodiment of the present disclosure, may include receiving, through a communication circuit from an external device, a first signal generated from the external device by vibrations occurring around the external device, determining whether the received first signal satisfies a selected condition, when the first signal satisfies the selected condition, generating a second signal by obtaining noise occurring around the electronic device using at least one microphone, and generating an acoustic signal to be output through a speaker based on the generated second signal, and when the first signal does not satisfy the selected condition, generating an acoustic signal to be output through the speaker irrespective of the second signal.

A method of removing noise using an electronic device, according to an embodiment of the present disclosure, may include generating a first signal by detecting vibrations occurring around the electronic device using at least one sensor, and generating an acoustic signal to be output through the speaker based on the first signal.

According to an embodiment of the present disclosure, the method may further include generating a second signal by obtaining noise occurring around the electronic device using at least one microphone, and generating an acoustic signal to be output through the speaker based on the first signal and the second signal.

According to an embodiment of the present disclosure, the method may further include determining whether the first signal satisfies a selected condition, when the first signal satisfies the selected condition, generating a second signal by obtaining noise occurring around the electronic device using at least one microphone, and generating an acoustic signal to be output through the speaker based on the generated second signal, and when the first signal does not satisfy the selected condition, generating an acoustic signal to be output through the speaker irrespective of the second signal.

According to an embodiment of the present disclosure, the method may further include receiving, through a communication circuit from an external device, a first signal generated from the external device by vibrations occurring around the external device, determining whether the received first signal satisfies a selected condition, generating a second signal by obtaining noise occurring around the electronic device using at least one microphone when the first signal satisfies the selected condition, and generating an acoustic signal to be output through the speaker based on the generated second signal, and when the first signal does not satisfy the selected condition, generating an acoustic signal to be output through the speaker irrespective of the second signal.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a speaker;

at least one microphone;

at least one sensor; and a control circuit that is electrically connected with the speaker, the at least one microphone, and the at least one sensor, wherein the control circuit is configured to:

generate a first signal by detecting vibrations occurring around the electronic device using the at least one sensor, generate a second signal by obtaining noise occurring around the electronic device using the at least one microphone, cancel a vibration frequency component of the first signal from the second signal, generate a noise cancellation signal based on the second signal from which the vibration frequency component of the first signal is removed, and generate an acoustic signal to be output through the speaker based on the noise cancellation signal.

2. The electronic device of claim 1, wherein the at least one sensor comprises a vibration sensor that is capable of converting vibrations into an electric signal, and wherein the vibration sensor comprises at least one of an acceleration sensor and an acoustic isolation microphone.

3. The electronic device of claim 1, wherein the at least one microphone is disposed in the front of the speaker or around the electronic device, and wherein the at least one sensor is disposed around the at least one microphone or the electronic device.

4. The electronic device of claim 1, wherein the control circuit is further configured to:

adjust an input gain of the second signal based on the first signal, generate a second noise cancellation signal based on the second signal of which the input gain is adjusted, and generate a second acoustic signal to be output through the speaker based on the second noise cancellation signal.

5. An electronic device comprising:

a communication circuit; and a control circuit that is electrically connected with the communication circuit, wherein the control circuit is configured to:

receive, using the communication circuit from an external device, a first signal generated from the external device by vibrations occurring around the external device using at least one sensor included in the external device, receive, using the communication circuit from the external device, a second signal generated from the external device by obtaining noise occurring around the external device using at least one microphone included in the external device, cancel a vibration frequency component of the first signal from the second signal, generate a noise cancellation signal based on the second signal from which the vibration frequency component of the first signal is removed, generate an acoustic signal to be output through the speaker included in the external device based on the noise cancellation signal, and transmit the acoustic signal to the external device.

6. The electronic device of claim 1, wherein the control circuit is further configured to:

determine whether the first signal satisfies a selected condition;

generate, when the first signal satisfies the selected condition, the second signal by obtaining noise occurring around the electronic device using at least one microphone, and generate a first acoustic signal to be output through the speaker based on the generated second signal, and generate, when the first signal does not satisfy the selected condition, a second acoustic signal to be output through the speaker, irrespective of the second signal.

7. The electronic device of claim 6, wherein the selected condition comprises a case in which a maximum value or an average value of at least some of the first signal is less than a threshold value.

8. A method of cancelling noise using an electronic device, the method comprising:

generating a first signal by detecting vibrations occurring around the electronic device using at least one sensor;

generating a second signal by obtaining noise occurring around the electronic device using at least one microphone;

removing a vibration frequency component of the first signal from the second signal;

generating a noise cancellation signal based on the second signal from which the vibration frequency component of the first signal is removed; and generating an acoustic signal to be output through the speaker based on the noise cancellation signal.

9. The method of claim 8, wherein the generating of the acoustic signal comprises:

determining whether the first signal satisfies a selected condition;

generating, when the selected condition is satisfied, the noise cancellation signal based on the second signal; and generating the acoustic signal to be output through the speaker based on the noise cancellation signal.

10. The method of claim 8, wherein the generating of the acoustic signal comprises:

adjusting an input gain of the second signal based on the first signal, generating a second noise cancellation signal based on the second signal of which input gain is adjusted, and generating a second acoustic signal to be output through the speaker based on the second noise cancellation signal.

11. A method of removing noise using an electronic device, the method comprising:

receiving, through a communication circuit from an external device, a first signal generated from the external device by vibrations occurring around the external device using at least one sensor included in the external device;

receiving, through a communication circuit from the external device, a second signal generated from the external device by obtaining noise occurring around the external device using at least one microphone included in the external device;

removing a vibration frequency component of the first signal from the second signal;

generating a noise cancellation signal based on the second signal from which the vibration frequency component of the first signal is removed;

generating an acoustic signal to be output through the speaker based on the noise cancellation signal; and transmitting the acoustic signal to the external device.

12. At least one non-transitory machine-readable storage medium for storing a computer program of instructions configured to be readable by at least one processor for instructing the at least one processor to execute a computer process for performing the method of claim 8.

* * * * *